United States Patent [19]

Ishii et al.

[11] Patent Number: 4,853,284

[45] Date of Patent: Aug. 1, 1989

[54] MECHANICAL PART

[75] Inventors: Takashi Ishii, Tokyo; Hajime Kohama, Yokohama; Hisao Yabe, Fujisawa, all of Japan

[73] Assignee: Kabushiki Kaisha Toshiba, Kawasaki, Japan

[21] Appl. No.: 19,336

[22] Filed: Feb. 26, 1987

[30] Foreign Application Priority Data

Feb. 28, 1986 [JP] Japan ..... 61-41524

[51] Int. Cl.[4] ..... B32B 15/04; B32B 15/06; B32B 15/08; B32B 27/06

[52] U.S. Cl. ..... 428/335; 428/336; 428/457; 428/464; 428/465; 428/469; 428/492; 428/500; 428/537.5; 428/701

[58] Field of Search ..... 428/469, 701, 335, 336, 428/465, 492, 457, 464, 537.5, 500; 427/226

[56] References Cited

U.S. PATENT DOCUMENTS 3,956,531 5/1976 Church et al. ..... 427/226
3,985,916 10/1976 Church et al. ..... 427/226 X
4,525,425 6/1985 Church ..... 428/469 X

FOREIGN PATENT DOCUMENTS 776443 6/1957 United Kingdom ..... 428/469
813660 5/1959 United Kingdom ..... 428/469
1466074 3/1977 United Kingdom ..... 428/469

*Primary Examiner*—Thomas J. Herbert
*Attorney, Agent, or Firm*—Oblon, Fisher, Spivak, McClelland & Maier

[57] ABSTRACT

A mechanical part brought into contact with a member selected from the group consisting of paper, rubber, plastics, resin, ceramics, and metal, comprises a substrate of an iron series metal and a surface layer formed on a surface of the substrate and containing chromium oxide ($Cr_2O_3$) as a major constituent. The chromium oxide ($Cr_2O_3$) is a material converted by heating a chromium compound, and an intermediate layer containing a reaction product between the substrate and chromium oxide in the surface layer is formed at an interface between the surface layer and the substrate.

9 Claims, No Drawings

MECHANICAL PART

BACKGROUND OF THE INVENTION

I. Field of the Invention

The present invention relates to a mechanical part having a wear-resistant surface which is brought into contact with a member selected from the group consisting of paper, rubber, plastics, resin, ceramics, and metal.

II. Description of the Prior Art

As is known, since iron and steel have superior mechanical properties, such as strength, ductility, toughness, hardness, and the like, to other metals, they are used for a machine material, structural material, and the like as the most basic material.

Iron and steel can be classified into iron, steel, and cast steel in accordance with their carbon contents. Furthermore, steel can be classified into carbon steel and alloy steel that is obtained by adding various elements to the carbon steel to provide specific characteristics. They are used for various applications in accordance with their characteristics.

Mechanical or structural parts consisting of steel must have required characteristics in accordance with conditions of use or environmental factors, in addition to the mechanical strength. When parts consisting of steel are used while being brought into frictional contact with other parts, a wear-resistance and a surface smoothness are required. For example, when parts, like bearing parts or sliding parts of a machine, are brought into frictional contact with each other, or when tools are brought into contact with other parts, the wear-resistance and the surface smoothness are required in order to prevent the wear of parts and to improve the sliding properties against other parts. When steel parts are used in a corrosive environment such as water, acid, alkali, and the like, for example in the case of a shaft or impeller of a submersible pump, a high resistance to chemicals is required.

In recent years, attempts have been made such that a surface layer which is different from a substrate is formed on the surface of parts, so that required characteristics according to conditions of use or environmental factors are provided to parts consisting of steel, in addition to the original characteristics of their material. Such a surface layer must have a wear resistance to friction with other parts and smoothness for improving sliding properties against other parts, must not damage other parts, and must have a resistance to chemicals high enough not to be corroded in a corrosive environment. Furthermore, the surface layer must be formed on the substrate surface of the parts with high mechanical strength, will not degrade characteristics of the substrate upon formation, and needs no finishing such as grinding after formation.

As a method for forming a surface layer on a substrate surface of parts consisting of iron or steel, plating, PVD (physical vapor deposition), CVD (chemical vapor deposition), frame spraying, and the like are known. However, these methods cannot always satisfy all the above-mentioned requirements, and practical application is not easily accomplished. More specifically, surface layers formed by these methods have insufficient denseness, wear-resistance, and smoothness. A bonding strength between the surface layer and the substrate is also insufficient, and the surface layer is often peeled from the substrate. In addition, a finishing process is required after the formation of the surface layer.

SUMMARY OF THE INVENTION

The present invention has been made in consideration of the above situation and has as its object to provide a mechanical part which has a surface layer which has superior wear resistance, smoothness, and resistance to chemicals, and can be easily formed on a substrate with high mechanical strength without impairing the substrate, and which is brought into contact with a member selected from the group consisting of paper, rubber, plastics, resin, ceramics, and metal.

According to the present invention, there is provided a mechanical part brought into contact with a member selected from the group consisting of paper, rubber, plastics, resin, ceramics, and metal, comprising a substrate of an iron series metal and a surface layer formed on a surface of said substrate and containing chromium oxide ($Cr_2O_3$) as a major constituent. The chromium oxide ($Cr_2O_3$) is a material converted by heating a chromium compound, and an intermediate layer containing a reaction product between the substrate and chromium oxide in the surface layer is formed at an interface between the surface layer and the substrate.

The mechanical part of the present invention includes various parts which are brought into contact with a member consisting of paper, rubber, plastics, resin, ceramics, or metal. Such a mechanical part includes parts such as bearing or sliding parts of a machine, e.g., a cylinder in engine parts or pump parts, which are brought into contact with an O-ring consisting of rubber or synthetic resin.

Examples of the substrate of the mechanical parts are carbon steel, stainless steel or other iron alloys.

The surface layer formed on the substrate of the mechanical parts according to the present invention has a dense structure of chromium oxide ($Cr_2O_3$) particles converted from a chromium compound upon heating and firmly bonded to each other. The surface layer is smooth and has a good wear-resistance property. Since the size of the precipitated $Cr_2O_3$ ceramic particles is very small (1 $\mu$m or less), the surface layer can be a dense, smooth layer substantially without pores and can be formed to be very thin. Therefore, inherent characteristics (e.g., elasticity) of the substrate can be effectively utilized. The hardness of the surface layer is as high as a Vicker's hardness (HV) of 500 or more. The intermediate layer as a reaction product between the material and chromium oxide is formed at the interface between the surface layer and the substrate. The surface layer can be formed on the substrate at high adhesion strength (50 kgf/cm$^2$). A thickness of the intermediate layer falls within the range of 0.5 to 3.0 $\mu$m. The surface layer also has high resistance to corrosion, a property for eliminating foreign materials, and high resistance to chemicals.

Chromium oxide ($Cr_2O_3$) contained in the surface layer serves to increase hardness and decrease a friction coefficient.

Mechanical parts with such a surface layer are manufactured by the following method. According to this method, a chromium compound solution such as aqueous solution of $CrO_3$ is applied to the surface of the substrate by means of coating or dipping. The substrate applied with the $CrO_3$ solution is baked at a temperature of 500° to 600° C. (preferably about 550° C.) in a reaction treatment, thereby forming a layer containing $Cr_2O_3$as a major constituent on a substrate surface region. A baking temperature of 500° to 600° C. allows conversion of $CrO_3$ to $Cr_2O_3$. A cycle of $CrO_3$ application and baking is repeated a plurality of times to form a dense, hard ceramic coating layer containing $Cr_2O_3$ on the surface of the substrate. A thickness of this layer is 1 to 50 μm. In this manner, the thickness is controlled by the number of cycles repeated as above. A thickness of the surface layer of the mechanical parts is preferably 1 to 10 μm, and more preferably, 2 to 6 μm. Since the baking temperature range falls within the range of 500° to 600° C., the substrate is not degraded.

Any chromium compound, including $CrO_3$ to be converted to $Cr_2O_3$ by heating, can be used. Examples of such a chromium compound are $NaCrO_4 \cdot 10H_2O$, $Na_2Cr_2O_7 \cdot 2H_2O$, $K_2CrO_4$, $K_2Cr_2O_7$ and $(NH_4)_2Cr_2O_7$. In addition, the solution is not limited to an aqueous solution, but can be substituted by a molten salt. A concentration of the solution is preferably 10 to 85%.

DETAILED DESCRIPTION OF THE PREFERRED EMBODIMENT

The present invention will be described hereinafter by way of its examples.

EXAMPLE 1

Austenite stainless steel (AISI304) and Ferrite stainless steel (AISI430) were used as substrates, and eight test samples including one having no surface layer, one having a surface layer according to the present invention, and one having a surface layer according to a conventional method were prepared, as shown in Table 1 below.

TABLE 1

| Test Sample No. | Forming Method of Surface Layer | Material of Surface layer | Thickness of Surface Layer (μm) | Hardness of Surface Layer (Hv) | Material of Substrate |
|---|---|---|---|---|---|
| 1 | No surface layer | — | — | 300 | AISI(304) |
| 2 | No surface layer | — | — | 250 | AISI(430) |
| 3 | Present invention | $Cr_2O_3$ | 4 to 5 | 600 | AISI(304) |
| 4 | Present invention | $Cr_2O_3$ | 4 to 5 | 550 | AISI(430) |
| 5 | PVD | TiC | 2 to 3 | 2,000 | AISI(304) |
| 6 | PVD | TiC | 2 to 3 | 2,000 | AISI(430) |
| 7 | CVD | TiN | 6 to 7 | 3,000 | AISI(304) |
| 8 | CVD | TiN | 6 to 7 | 3,000 | AISI(430) |

A finishing process was performed for the substrate surfaces of test samples No. 1 and No. 2, and no finishing process was performed for test samples No. 3 and No. 4 after formation of the surface layers. Test samples No. 5 to No. 8 were subjected to a finishing process after formation of the surface layers.

As for test samples No. 3 and No. 4, the surface layer was formed on the substrate surface as follows. More specifically, a substrate was dipped in a 50% aqueous solution of chromic acid ($CrO_3$) for 1 to 2 minutes. After the substrate was dried, it was baked in air at a temperature of 500° to 600° C. A cycle of the aforementioned processes was repeated 16 times, thereby forming a 5-μm thick surface layer on the substrate surface. The surface layer was constituted by an intermediate layer having a reaction product ($FeO \cdot Cr_2O_3$) of the substrate and $CrO_3$, and $Cr_2O_3$as a major constituent, and a layer containing $Cr_2O_3$converted from $CrO_3$ as a major constituent.

These test samples were tested in order to examine their wear-resistance and resistance to chemicals.

Wear-Resistance Test

The wear-resistance was examined by a high-speed fiber sliding test. The test conditions were as follows:

Fiber: Polyester 50d/48f
Speed: 3.5 m/sec
Tension: 65 g
Test Time: 24 hr
Table 2 shows the test results.

TABLE 2

| Test Sample No. | Forming Method of Surface Layer | Material of Surface Layer | Rank and State of Damage |
|---|---|---|---|
| 1 | No surface layer | — | x Large wear mark: No breakage of yarn for 24 hr |
| 3 | Present invention | $Cr_2O_3$ | No wear mark: No breakage of yarn for 24 hr |
| 5 | PVD | TiC | Δ Small wear mark: Yarn was broken after 20 hr |
| 7 | CVD | TiN | Δ Medium wear mark: Yarn was broken after 12 hr |

As can be understood from Table 2, the test sample of the present invention had no wear mark and no breakage of yarn after a 24-hr travel of yarn.

Corrosion-Resistance Test

The corrosion-resistance of the test samples was tested such that a decrease in weight of the samples by dipping them into an aqueous solution of hydrochloric acid was measured. The test conditions were as follows:

Concentration of Solution: 5%, 10%
Temperature: Ambient Temperature
Dipping Time: 24 hr
Table 3 shows the test results.

TABLE 3

| Test Sample No. | Forming Method of Surface Layer | Concentration of Hydrochloric Acid 5% | 10% |
|---|---|---|---|
| 1 | No surface layer | 0.72 mg/cm$^2$ | 2.5 mg/cm$^2$ |

TABLE 3-continued

| Test Sample No. | Forming Method of Surface Layer | Concentration of Hydrochloric Acid 5% | 10% |
|---|---|---|---|
| 3 | Present invention | 0 | 0.1 mg/cm$^2$ |

As can be understood from Table 3, the test sample of the present invention had an excellent corrosion resistance.

EXAMPLE 2

A cylinder of austenite stainless steel (AISI304), which had an outer diameter of 34 mm, an inner diameter of 30 mm, and a length of 100 mm, was used as a substrate, and two types of test samples were prepared. One test sample had a surface layer according to the present invention, and the other test sample had a surface layer according to a conventional method.

More specifically, test sample No. 9 had a surface layer formed according to the present invention. The substrate was dipped in an 80% $CrO_2$ aqueous solution for 1 to 2 minutes. Thereafter, the substrate was baked in air at a temperature of 500° to 600° C. A cycle of the aforementioned processes was repeated 15 times, thereby forming a 5-μm thick surface layer on the substrate.

Test sample No. 10 had a surface layer formed according to the conventional method. A chromium layer having a thickness of 30 to 40 μm was formed on the substrate by chromium plating.

The two samples were set in a test plunger pump as cylinders, and a wear-resistance test of the inner surfaces was carried out. More specifically, a 2% aqueous solution of slaked lime was continuously fed by the plunger pump. Then, wear of the surface layer on the cylinder inner surface after 300 hours was measured and the state of the inner surface was observed. Note that during the operation of the pump, a sliding member which was made of rubber and was mounted at the distal end of a shaft was reciprocally moved inside the cylinder at a rate of 120 strokes/min.

As a result, the wear of the inner surface of test sample No. 9 was 2 μm, and no change in inner surface state was found. However, the wear of the inner surface of test sample No. 10 was 45 μm, and the surface layer was worn almost completely and the substrate was exposed therefrom.

According to the present invention as described above, a mechanical part which has a surface layer which has superior wear resistance, smoothness, and resistance to chemicals, and can be easily formed on a substrate with high mechanical strength without impairing the substrate, and which is brought into contact with a member selected from the group consisting of paper, rubber, plastics, resin, ceramics, and metal can be provided.

What is claimed is:

1. A mechanical part which is in contact with a non-fibrous member selected from the group consisting of paper, rubber, plastics, resin, ceramics, and metal, comprising a non-porous substrate of an austenite stainless steel or a ferrite stainless steel and a surface layer formed on a surface of said substrate and containing chromium oxide ($Cr_2O_3$) as a major constituent, the chromium oxide being converted from a chromium compound upon heating thereof, and an intermediate layer including a reaction product between the chromium oxide and said surface layer and said substrate being formed at an interface between said surface layer and said substrate.

2. A mechanical part according to claim 1, wherein said surface layer has a thickness of 1 to 560 μm.

3. A mechanical part according to claim 1, wherein said surface layer has a thickness of 1 to 10 μm.

4. A mechanical part according to claim 1, wherein said surface layer has a thickness of 2 to 6 μm.

5. A mechanical part according to claim 1, wherein the chromium compound is $CrO_3$.

6. A mechanical part according to claim 1, wherein said intermediate layer has a thickness of 0.5 to 3.0 μm.

7. A mechanical part according to claim 1, wherein said intermediate layer comprises $FeO{\cdot}Cr_2O_3$ and $Cr_2O_3$.

8. A mechanical part according to claim 1, wherein said mechanical part is a bearing part of a machine;.

9. A mechanical part according to claim 1, wherein said mechanical part is a sliding part in an engine or a pump.

* * * * *